US005546965A

United States Patent [19]

White

[11] Patent Number: 5,546,965

[45] Date of Patent: Aug. 20, 1996

[54] CIGARETTE WITH IMPROVED FUEL ELEMENT INSULATOR

[75] Inventor: Jackie L. White, Pfafftown, N.C.

[73] Assignee: R. J. Reynolds Tobacco Company, Winston-Salem, N.C.

[21] Appl. No.: 263,626

[22] Filed: Jun. 22, 1994

[51] Int. Cl.[6] ..... A24F 47/00; A24D 1/00

[52] U.S. Cl. ..... 131/194

[58] Field of Search ..... 131/194

[56] References Cited

U.S. PATENT DOCUMENTS 4,714,082 12/1987 Banerjee et al. .
4,732,168 3/1988 Resce et al. .
4,756,318 7/1988 Clearman et al. .
4,771,795 9/1988 White et al. .
4,782,644 11/1988 Haarer et al. .
4,793,365 12/1988 Sensabaugh, Jr. et al. .
4,802,568 2/1989 Haarer et al. .
4,819,665 4/1989 Roberts et al. .
4,827,950 5/1989 Banerjee et al. .
4,854,331 8/1989 Banerjee et al. .
4,858,630 8/1989 Banerjee et al. .
4,881,556 11/1989 Clearman et al. .
4,893,637 1/1990 Hancock et al. .
4,893,639 1/1990 White .
4,903,714 2/1990 Barnes et al. .
4,917,128 4/1990 Clearman et al. .
4,928,714 5/1990 Shannon .
4,938,238 7/1990 Barnes et al. .
4,966,171 10/1990 Serrano et al. .
4,967,774 11/1990 White .
4,981,522 1/1991 Nichols et al. .
4,989,619 2/1991 Clearman et al. .
4,991,606 2/1991 Serrano et al. .
5,019,122 5/1991 Clearman et al. .
5,020,548 6/1991 Farrier et al. .
5,027,836 7/1991 Shannon et al. .
5,027,837 7/1991 Clearman et al. .
5,033,483 7/1991 Clearman et al. .
5,042,509 8/1991 Banerjee et al. .
5,052,413 10/1991 Baker et al. .
5,060,666 10/1991 Clearman et al. .
5,065,776 11/1991 Lawson et al. .
5,067,499 11/1991 Banerjee et al. .
5,076,292 12/1991 Sensabaugh, Jr. et al. .
5,076,296 12/1991 Nystrom et al. .
5,076,297 12/1991 Farrier et al. .
5,088,507 2/1992 Baker et al. .
5,099,861 3/1992 Clearman et al. .
5,105,831 4/1992 Banerjee et al. .
5,105,837 4/1992 Barnes et al. .
5,119,834 6/1992 Shannon et al. .
5,119,837 6/1992 Banerjee et al. .
5,129,409 7/1992 White et al. .
5,133,368 7/1992 Neumann et al. .
5,137,034 8/1992 Perfetti et al. .
5,146,934 9/1992 Deevi et al. .
5,156,170 10/1992 Clearman et al. .
5,159,940 11/1992 Hayward et al. .
5,178,167 1/1993 Riggs et al. .
5,183,062 2/1993 Clearman et al. .
5,188,130 2/1993 Hajaligol et al. .
5,203,355 4/1993 Clearman et al. .
5,211,684 5/1993 Shannon et al. .
5,240,016 8/1993 Nichols et al. .
5,247,947 9/1993 Clearman et al. .
5,303,720 4/1994 Banerjee et al. .

OTHER PUBLICATIONS

U.S. Serial No. 07/800,679 – filed Jan. 2, 1991.
U.S. Serial No. 07/882,209 – Filed May 13, 1992.
Tobacco Flavoring For Smoking Products, RJR (1972).

*Primary Examiner*—Jennifer Bahr

[57] ABSTRACT

The present invention provides improved cigarettes and other smoking articles employing short fuel elements and physically separate aerosol generating means wherein the fuel element is provided with an improved insulating means comprising extremely fine gauge (e.g., about 0.002 inch diameter) wire, woven into a cloth-like material of about 200 mesh.

19 Claims, 1 Drawing Sheet

CIGARETTE WITH IMPROVED FUEL ELEMENT INSULATOR

BACKGROUND OF THE INVENTION

The present invention relates to smoking articles such as cigarettes, and in particular, to those smoking articles having a short fuel element and a physically separate aerosol generating means. These smoking articles are capable of providing the smoker with the pleasures of smoking (e.g., smoking taste, feel, satisfaction, and the like). The following U.S. Pat. Nos. are directed to such articles; 4,714,082; 4,732,168; 4,756,318; 4,771,795; 4,782,644; 4,793,365; 4,802,568; 4,819,665; 4,827,950; 4,854,331; 4,858,630; 4,881,556; 4,989,619; 4,893,637; 4,893,639; 4,903,714; 4,917,128; 4,928,714; 4,938,238; 4,966,171; 4,967,774; 4,981,522; 4,989,619; 4,991,606; 5,019,122; 5,020,548; 5,027,836; 5,027,837; 5,033,483; 5,042,509; 5,052,413; 5,060,666; 5,065,776; 5,067,499; 5,076,292; 5,076,296; 5,076,297; 5,088,507; 5,099,861; 5,105,831; 5,105,837; 5,119,834; 5,119,837; 5,129,409; 5,133,368; 5,137,034; 5,146,934; 5,156,170; 5,159,940; 5,178,167; 5,183,062; 5,188,130; 5,203,355; 5,211,684; 5,240,016; 5,247,947; and 5,303,720, and their disclosures are hereby incorporated herein by reference.

Many of the smoking articles described in the above cited prior art employ a combustible fuel element for heat generation and an aerosol generating means positioned physically separate from, and in a heat exchange relationship with, the fuel element. The aerosol generating means typically includes one or more aerosol forming substances such as glycerin in or on a substrate or carrier. These smoking articles also normally include tobacco in various forms such as cut filler, reconstituted tobaccos, densified pellets, tobacco dust and tobacco extracts, as well as tobacco flavor modifiers and tobacco flavoring agents. During smoking, heat generated by the fuel element acts to volatilize the aerosol forming substances, thereby providing an aerosol which resembles tobacco smoke. Such smoking articles yield extremely low levels of visible sidestream smoke as well as low levels of FTC "tar."

Many of the smoking articles described above employ an insulated fuel element and some use an insulating material such as nonrespirable glass fibers. See, e.g., U.S. Pat. Nos. 5,027,836, and 5,303,720. One common example of such glass fibers is Owen-Corning C-glass, the fibers of which have an average diameter of about 8 μm. Other types of insulating material sometimes include tobacco, tobacco paper, alumina, mineral wool, carbon, organic polymers, pearlite glass, calcium sulfate fibers, and/or calcium or sodium phosphate fibers. The present invention represents an alternative to the previously employed insulating materials.

SUMMARY OF THE INVENTION

The present invention provides an improved insulating means for cigarettes and other smoking articles employing short fuel elements and physically separate aerosol generating means. The improved insulating means comprises a woven wire cloth material. Preferably, the wire is extremely fine gauge (e.g., about 0.002 inches in diameter) wire, and is woven in a fine mesh form (e.g., 200 mesh) and is made of a metal (e.g., aluminum).

It has surprisingly been discovered that wire cloth as described above is particularly well suited for use as an insulating means around the preferred short carbon fuel in the cigarettes of the present invention. Being a metal (or noncombustible synthetic) wire, it is chemically inert and non-burnable under the conditions typically encountered during smoking. The wire cloth insulating material of the present invention is both non-fibrous and inorganic, and thus contributes neither off-tastes nor foreign materials to the mainstream aerosol.

The wire cloth insulating material is normally formed around the fuel element in multilayers to provide an insulating jacket having a thickness of from about 0.5 mm to about 3.0 mm, preferably about 1.0 to about 2.5 mm, and most preferably about 1.5 to about 2.0 mm. Such a jacket is resilient to the touch. The mesh opening in the wire cloth material provides a porous layer which performs as a good insulating material, but also allows sufficient oxygen through the periphery to sustain combustion of the fuel element as required.

In one preferred embodiment, the wire cloth insulating material consists of extremely fine gauge (0.002 inch) aluminum wire, woven into a cloth like material of about 200 mesh. A piece of this material (about 12 mm×120 mm) and weighing about 0.15 g is rolled around a 12 mm fuel element. The wire cloth insulating material is very porous and multi-layered. Because of the nature of the wire cloth material, when wrapped or rolled around itself, it forms a good fuel element insulator.

DETAILED DESCRIPTION OF A PREFERRED EMBODIMENT

Figure 1:
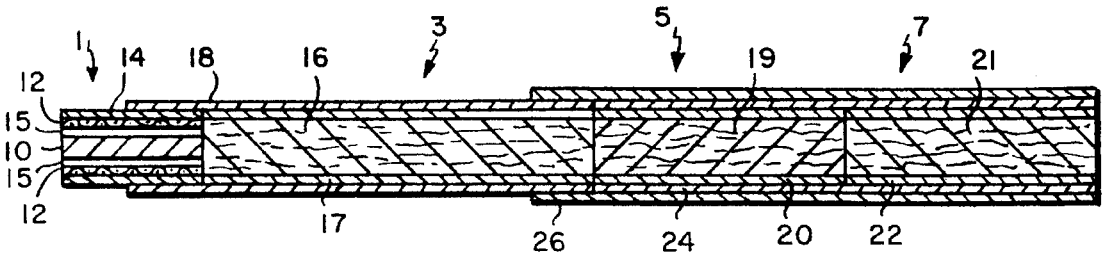
FIG. 1 is a longitudinal sectional view of a cigarette of the present invention.
Figure 1A:
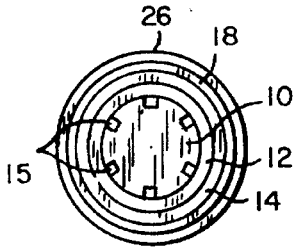
FIG. 1A is a front end view of the cigarette illustrated in FIG. 1.

The cigarette illustrated in FIGS. 1 and 1A, has a fuel element 10, which includes a number of grooves 15 running along its longitudinal periphery. As shown, the improved wire cloth insulating jacket of the present invention 12 surrounds the periphery of the fuel element. An outer paper wrapper 14 may comprise one layer or may be prepared from a plurality of separate layers, each having different porosity and ash stability characteristics.

The aerosol generating means, which includes substrate 16 contains one or more aerosol forming materials and/or flavorants is situated behind the insulated fuel element 10. The substrate material 16 may be any one of a number of materials, including reconstituted tobacco or tobacco paper, wood paper, heat-stabilized paper, e.g., paper treated with one or more hydrated salts; tobacco paper and the like. See U.S. Pat. Nos. 5,183,062, 5,203,335 and U.S. patent application Nos. 07/800,679, filed Nov. 2, 1991 and 07/882,209, filed May 13, 1992.

The aerosol generating means also includes at least one aerosol forming material, on or in the substrate. The aerosol forming material generally has a liquid form. Examples of preferred aerosol forming materials include the polyhydric alcohols (e.g., glycerin, propylene glycol and triethylene glycol), the aliphatic esters of mono-, di-, or poly-carboxylic acids (e.g., methyl stearate, dimethyl dodecandioate and dimethyl tetradecanedioate), and the like.

Substrate 16 is overwrapped with an overwrap 17 which may include a barrier material to reduce or preferably prevent any migration of the aerosol forming materials from the substrate to other parts of the cigarette. Preferably, the overwrap comprises a laminated foil/paper combination.

Spaced longitudinally behind the substrate 16 is a segment of reconstituted tobacco 19, overwrapped with paper 20. This tobacco segment is used to provide tobacco flavors to the aerosol emitted from the aerosol generating means.

Positioned at the extreme mouth end of the cigarette is a low-efficiency filter element 21, overwrapped with paper 22. Standard paper overwrap 24 combines the tobacco section 19 and the filter 21.

Circumscribing the insulated fuel element, at a point about 2 to 8 mm from the lighting end of the cigarette, and combining it with barrier wrapper 17 is a non-burning wrapper 18. Wrapper 18 is preferably a laminated aluminum foil—paper structure. This wrapper minimizes or prevents peripheral (radial) air from flowing to the portion of the fuel element disposed longitudinally behind its forward edge, thereby causing oxygen deprivation and preventing excessive combustion. A tipping paper 26 is used to join the filter/tobacco cut filler segment to the front end segment to form the cigarette.

The fuel elements employed herein should meet three criteria; (1) they should be easy to ignite, (2) they should supply enough heat to produce aerosol for about 5–15, preferably about 8–12 puffs; and (3) they should not contribute off-taste or unpleasant aromas to the cigarette.

The preferred fuel element for use in the smoking articles of the present invention is manufactured from a combustible material in such a way that the density of the fuel element is greater than about 0.5 g/cc, frequently about 0.7 g/cc or more, often about 1 g/cc or more, sometimes about 1.5 g/cc or more, but typically less than about 2 g/cc. Additionally, the fuel element generally has a length, prior to burning, of less than about 20 mm, often less than about 15 mm, and preferably about 12 mm.

The composition of the combustible material of the fuel element can vary. Preferred fuel elements contain carbon, and highly preferred fuel elements are composed primarily of carbonaceous materials. Preferred carbonaceous materials have a carbon content above about 60 weight percent, more preferably above about 75 weight percent, and most preferably above about 85 weight percent. Flavors, tobacco, tobacco extracts, fillers (e.g. clays or calcium carbonate), graphite, burn additives (e.g., sodium chloride to improve smoldering and act as a glow retardant), combustion modifying agents (e.g., potassium carbonate to control flammability), binders, and the like, can be incorporated into the fuel element.

Surrounding the outer periphery of the fuel element is an improved insulating member, which comprises one or more layers of wire cloth. An especially preferred source of suitable wire cloth is Tetko Inc., 333 S. Highland Avenue, Briarcliff, N.Y. 10510. The wire cloth useful herein as an insulator may be manufactured from either metals or high temperature stable synthetic materials. Suitable metals include aluminum, brass (70/30), bronze, copper, nickel, stainless steel (302, 304, etc.), steel and titanium, and the like. Suitable synthetic materials which are stable when exposed to high temperatures (i.e., temperatures achieved by the fuel elements used herein) will be readily apparent to the skilled artisan and include Kevlar, Nomex, and the like.

The preferred wire cloth is a metal such as aluminum, and is available in many combinations of wire diameters and mesh count. Mesh count is defined as the number of openings in a lineal inch, measured from the center of one wire to a point one inch distant. The mesh count preferably ranges from about 50 to 400, most preferably from about 100 to 300. The diameter of the wire can range from about 0.063 inches to about 0.0008 inches, preferably from about 0.0005 inches to about 0.005 inches, and most preferably from about 0.001 inches to about 0.003 inches.

The preferred metal wire cloth is also available several variations of weave pattern, e.g., Plain Square Weave, Twilled Square Weave, Plain Dutch Weave, Twilled Dutch Weave, Robusta Reverse Dutch Weave, Braided or Basket Weave, and the like, each of which will afford different insulating properties to the cigarette. Metal cloth having these weave patterns is commercially available from G. Bopp & Co. of Zurich, Switzerland, and their U.S. distributor, Tetko Inc, 333 Mount Highland Avenue, Briarcliff Manor, N.Y. 10510, or Gerard Daniel Co., Inc., 5 Plain Avenue, New Rochelle, N.Y. 10801.

The mesh size of the wire cloth can vary from about 2×2 to about 635×635. The open area of the wire cloth can vary considerably. For instance, a 2×2 mesh wire cloth made with 0.063 inch diameter wire has an open area of 76.4%. A 635×635 mesh wire cloth made with 0.0008 inch diameter wire has an open area of 25.8%. The degree (or amount) of open area is an important factor in employing wire cloth as an insulating means for cigarettes as described herein, because more open area means more insulation power, whereas less open area means both less insulation power and less oxygen admission to the fuel element. The larger open areas also decrease the conductivity of the wire cloth. Preferably a balance is achieved such that the fuel element receives sufficient oxygen for burning, and the fuel element is adequately insulated to prevent scorching or burning of materials which come into peripheral contact with the cigarette. If desired, two or more different wire cloths, each providing different open area may be combined, e.g., either in several overlapping layers, or sequentially, i.e., in a manner which provides the desired level(s) of insulating properties. These modifications may also include texturizing or corrugating of the wire cloth to modify the open area or degree of insulating power achieved by use of such materials.

For testing purposes, an aluminum wire cloth, having a plain square weave was selected. This material was 200 mesh with 0.0021 inch diameter wire with the open area of 33.6%. NOTE: this insulator does not necessarily represent the optimization of the present invention. In fact, it is believed that other modifications can be made in this insulator which will show better performance characteristics. The test insulator however, did serve to prove the utility of the presently claimed invention. In use, this 200 mesh material served adequately as an insulator for an ignited fuel element; i.e., there was no burning of paper placed in contact with the periphery of the cigarette having this insulating means over the fuel element. In addition, the fuel element performed normally, providing the full number of desired puffs.

As described above, the aerosol generating means comprises a substrate material and one or more aerosol forming materials. In the present invention the substrate is a tobacco material, although other materials are also suitable. The aerosol forming material may include a mixture of a polyhydric alcohol such as glycerin and volatile flavoring agents such as tobacco extracts, high fructose corn syrup, and the like. Examples of other aerosol forming materials include volatile flavoring agents and tobacco flavor modifiers. Volatile flavoring agents include vanillin, cocoa, licorice, organic acids, high fructose corn syrup, and the like. Various other flavoring agents for smoking articles are set forth in Leffingwell et al., *Tobacco Flavoring For Smoking Products* (1972). Tobacco flavor modifiers include levulinic acid, metal (e.g., sodium, potassium calcium and magnesium) salts of levulinic acid, and the like.

As illustrated, the smoking articles of the present invention incorporate one or more forms of tobacco. The form of the tobacco can vary, as can the location or locations of the tobacco in the particular smoking article. The tobacco can be incorporated in the fuel element, the aerosol generating means, and/or positioned within the mouthend piece in a manner so that various flavorful tobacco components are transferred to drawn aerosol passing through the mouthend piece. The type of tobacco can vary, and includes flue-cured, Burley, Maryland and Oriental tobaccos, and/or known rare and specialty tobaccos, as well as blends of any thereof.

The extreme mouthend of the smoking article preferably includes a filter element, or filter tip, particularly for aesthetic reasons. Preferred filter elements are low efficiency filter elements which do not interfere appreciably with aerosol yields. Suitable filter materials include low efficiency cellulose acetate or polypropylene tow, baffled or hollow molded polypropylene materials, or gathered webs or nonwoven polypropylene materials.

The entire length of the smoking article, or any portion thereof, can be overwrapped with paper. Preferred papers which circumscribe the front end of the smoking article having the insulated fuel element and sleeve assembly, should not openly flame during use of the smoking article, should have controllable smolder properties, and should produce a gray ash. Suitable papers are well known in the art.

Smoking articles of the present invention are capable of providing at least about 6 to about 10 puffs, when smoked under FTC smoking conditions. FTC smoking conditions consist of a 35 ml puff volume of 2 seconds duration, separated by 58 seconds of smolder. Preferred smoking articles of the present invention are capable of yielding at least about 0.6 mg of aerosol, measured as wet total particulate matter (WTPM), in the first 3 puffs, when smoked under FTC smoking conditions. Moreover, preferred smoking articles yield an average of at least about 0.2 mg of WTPM per puff, for at least about 6 puffs, preferably at least about 10 puffs, when smoked under FTC smoking conditions. Highly preferred smoking articles yield at least about 5 mg of WTPM over at least 10 puffs, when smoked under FTC smoking conditions.

The following example is provided in order to further illustrate the preferred embodiment of the present invention, but should not be construed as limiting the scope thereof. Unless otherwise noted, all parts and percentages are by weight.

EXAMPLE 1

CIGARETTE OF FIG. 1

HEAT SOURCE SECTION (1):

The overall length of the entire Heat Source Section is 12 mm. The diameter of this section is 7.5 mm (i.e., the diameter of a cigarette). The component parts of the heat source section include the carbon fuel element, the insulating means, and a paper overwrap which connects the heat source section to the remainder of the cigarette.

Carbon Fuel Element

The carbon fuel element has a length of 12 mm and a diameter of 4.2 mm. The fuel element composition is: 10 wt. % ammonium alginate binder; 5 wt. % ball-milled tobacco powder; 1 wt. % sodium carbonate; 6 wt. % calcium carbonate; 78 wt. % powdered hardwood carbon (average particle size 12 micron; prepared in an inert atmosphere). The fuel element is formed by extrusion and has five equally spaced peripheral slots (15), each having a depth of 1 mm and a width of 0.5 mm in the outer surface (i.e., the periphery).

The hardwood pulp carbon is prepared by carbonizing a non-talc containing grade of Grande Prairie Canadian kraft hardwood paper in an inert atmosphere, increasing the temperature in a step-wise manner sufficient to minimize oxidation of the paper, to a final carbonizing temperature of at least 750° C. The resulting carbon material is cooled in the inert atmosphere to less than 35° C., and ground to fine power having an average particle size (as determined using a Microtrac Analyzer, Leeds & Northrup) of about 12 μm in diameter.

Insulating Means

Surrounding the outer periphery of the fuel element is the improved insulating member, which comprises wire cloth which is commercially available from Tetko Inc., 333 S. Highland Avenue, Briarcliff, N.Y. 10510. The wire cloth is an aluminum wire cloth having a plain square weave. The material is 200 mesh consisting of 0.0021 inch diameter wire, with an open area of 33.6%. A piece of this material, about 12 mm×120 mm and weighing about 0.15 g is wrapped or rolled around the fuel element in several layers to provide a final outer diameter of about 7.5 mm. The wire cloth covers only the fuel element, i.e., the final length of the insulator is about 12 mm.

RECONSTITUTED TOBACCO SUBSTRATE (3):

The substrate is a reconstituted tobacco substrate in cut filler form, with a length of 31 mm and a diameter of 7.5 mm. The reconstituted tobacco cast sheet material is provided with high levels of glycerin as the aerosol former. The base sheet composition is: 65 wt. % glycerin; 26 wt. % extracted tobacco powder; 5 wt. % ammonium alginate; 4 wt. % DAP (diammonium phosphate). On a percentage dry wt. basis, the substrate material has an approximately 10–12% moisture content. The sheet is also top loaded with −16 mesh size tobacco particles. The finished sheet is then 80% base sheet and 20% top load by weight. The target moisture of the finalized product is 6–7%.

The substrate is overwrapped with a 31 mm long paper—aluminum foil laminate having a width of about 25.5 mm to form a substrate rod. The foil in the laminate is cast aluminum, 0.0005 inches thick, and the paper is a Simpson Paper Company product known as R JR LAM-5002 paper. The laminate overwrap is formed with a commercial adhesive, Airflex 465 or silicate adhesive.

RECONSTITUTED TOBACCO ROLL (5):

Following the substrate, there is another segment of tobacco, having a length of about 30 mm and a diameter of about 7.5 mm. This segment is a reconstituted tobacco sheet, in cut filler form, comprising the following ingredients (on a dry weight basis); 95.4% reconstituted tobacco; 3.6% glycerin; and 1.0% potassium carbonate. The moisture content of this cut filler is about 13.5%. The reconstituted tobacco material is prepared in cut filler form and is treated with a 6% casing (comprising 60% glycerin/water solution and potassium carbonate).

FILTER ROD (7)

The filter rod has a length of about 10 mm and a diameter of about 7.5 mm. The preferred material for this filter rod is cellulose acetate tow which is commercially available from numerous sources. A cellulose acetate filter rod about 7.5 mm diameter is formed from a 10/35,000 Denier tow width 0.6% triacetin overwrapped with a 25.5 mm wide web of 646 plug wrap available from Kimberly-Clark or Ecusta on a standard filter rodmaker. The overwrapped rod is cut into 20 mm length segments.

PAPER OVERWRAP:

A paper—aluminum foil—paper laminate overwraps 4 mm of the mouthend side of the heat source section 1 and all of substrate 3. The foil layer is not porous, so there is no air flow through the laminate along either the heat source section 1 or substrate section 3.

This front end overwrap tipping paper is advantageously formed by laminating several papers including; an outer layer of Ecusta 29492 paper, an intermediate layer of 0.0005 inch thick aluminum foil and an inner layer of Ecusta 29492 paper. The laminated layers are held together with an adhesive, LAM-5002, from R. J. Reynolds Tobacco Co., using 1.5 pounds of adhesive per ream of paper.

The mouthend piece assembly and the front end piece assembly are aligned so that the substrate abuts the tobacco paper plug and these sections are secured together by a tipping paper about 45 mm in length to form a cigarette.

The cigarette is smoked, and yields visible aerosol and tobacco flavor (i.e., volatilized tobacco components) on all puffs for about 10–12 puffs. The fuel element burns to about 6 mm back, i.e., to about the region where the foil lined tube overwraps the fuel element, and there the cigarette self-extinguishes. After the fuel element had been ignited, the cigarette of FIG. 1 was placed upon a flat piece of paper, which neither scorched nor ignited due to the insulating properties of the wire cloth insulating means.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A smoking article comprising:

(a) a combustible fuel element less than about 30 mm in length prior to smoking, said fuel element being insulated by an insulating material surrounding at least a portion of the periphery thereof; and (b) a physically separate aerosol generating means disposed longitudinally behind the fuel element comprising a substrate material bearing an aerosol forming material;

wherein the insulating material for the fuel element comprises a wire cloth or a noncombustible synthetic cloth material.

2. The smoking article of claim 1, wherein the wire cloth insulating material comprises a metal.

3. The smoking article of claim 2, wherein the metal wire is aluminum.

4. The smoking article of claim 1, wherein the noncombustible synthetic insulating material comprises a high temperature stable synthetic material.

5. The smoking article of claim 1, wherein the wire cloth insulating material comprises several resilient layers, providing a thickness of insulating material of from about 0.5 to about 3 mm around the periphery of the fuel element.

6. The smoking article of claim 5, wherein the thickness of the resilient wire cloth insulating material is from about 1 to 2.5 mm.

7. The smoking article of claim 5, wherein the thickness of the resilient wire cloth insulating material is from about 1.5 to about 2 mm.

8. The smoking article of any of claims 1–7, wherein the wired cloth insulating material is woven into a pattern selected from the group consisting of Plain Square Weave, Twilled Square Weave, Plain Dutch Weave, Twilled Dutch Weave, Robusta Reverse Dutch Weave, Braided Weave and Basket Weave.

9. The smoking article of any of claims 1–7, wherein the mesh count ranges from about 50 to 400.

10. The smoking article of any of claims 1–7, wherein the mesh count ranges from about 100 to 300.

11. The smoking article of any of claims 1–7, wherein the diameter of the wire ranges from about 0.0008 inches to about 0.063 inches.

12. The smoking article of any of claims 1–7, wherein the diameter of the wire ranges from about 0.0005 inches to about 0.005 inches.

13. The smoking article of any of claims 1–7, wherein the diameter of the wire ranges from about 0.001 inches to about 0.003 inches.

14. The smoking article of any of claims 1–7, wherein the open area of the wire cloth insulator ranges from about 20% to about 80%.

15. The smoking article of claim 14, wherein the open area of the wire cloth insulator ranges from about 30% to about 70%.

16. The smoking article of claim 14, wherein the open area of the wire cloth insulator ranges from about 40% to about 60%.

17. The smoking article of any of claims 1–7, wherein the wire cloth insulator has been texturized or corrugated to modify the open area or degree of insulating power thereof.

18. The smoking article of claim 1, wherein the wire cloth insulator comprises an aluminum wire cloth, having a plain square weave.

19. The smoking article of claim 18, wherein the wire cloth insulator has a mesh count of 200 and a wire diameter of 0.0021 inches, providing an open area of 33.6%.

* * * * *